US005573484A

United States Patent [19]

Carpenter

[11] Patent Number: 5,573,484

[45] Date of Patent: Nov. 12, 1996

[54] WEIGHTED AUXILIARY HANDLE FOR DUMBBELL

[75] Inventor: David P. Carpenter, Dunkirk, Md.

[73] Assignee: M. Michael Carpenter, Los Angeles, Calif.; a part interest

[21] Appl. No.: 394,892

[22] Filed: Feb. 27, 1995

[51] Int. Cl.[6] ..... A63B 21/072

[52] U.S. Cl. ..... 482/108

[58] Field of Search ..... 482/93, 105–109

[56] References Cited

U.S. PATENT DOCUMENTS

| | | | |
|---|---|---|---|
| 4,231,569 | 11/1980 | Rae | 482/93 X |
| 4,531,723 | 7/1985 | Wright . | |
| 4,743,017 | 5/1988 | Jaeger . | |
| 4,768,780 | 9/1988 | Hayes | 482/108 |
| 5,350,345 | 9/1994 | Frey | 482/93 X |

FOREIGN PATENT DOCUMENTS

| | | | |
|---|---|---|---|
| 2230708 | 10/1990 | United Kingdom | 482/108 |

*Primary Examiner*—Richard J. Apley
*Assistant Examiner*—John Mulcahy
*Attorney, Agent, or Firm*—M. Michael Carpenter

[57] ABSTRACT

An auxiliary handle for a dumbbell includes a pair of weighted hook members each joined to a handle by a threaded stud. The hook members are adapted to engage the handle of a dumbbell. The studs are oppositely threaded so that rotation of the handle in one direction moves the hook members away from each other and into engagement with the dumbbell weights, thus securing the auxiliary handle to the dumbbell. The auxiliary handle may be used by a spotter to assist in handling the dumbbell.

10 Claims, 3 Drawing Sheets

WEIGHTED AUXILIARY HANDLE FOR DUMBBELL

BACKGROUND OF THE INVENTION

The present invention relates to an exercise device and, more particularly, to an improved exercise device that may be used with dumbbells.

The use of weights to enhance calisthenics exercise is well known. A barbell, consisting of a bar with weighted disks at each end which may be adjusted to increase or decrease the weight of the bar, is used to exercise the legs, back and shoulders of its user. Such exercises as the clean and jerk, the snatch and the press using a barbell are part of Olympic competition in which Olympic records are broken by fractions of a pound. Dumbbells are used to exercise the arm muscles and, like the larger barbell, consist of a shorter bar with two identical spheres formed on each end. The dumbbell may be made as a solid casting or with adjustable weighted disks attached to each end.

The dumbbells with adjustable weights on each end are generally sold for an individual's home use. Most commercial or club gymnasiums use either the solid cast dumbbell or a dumbbell having its weighted disks permanently attached as by welding. In gymnasiums, it is not desirable to have adjustable dumbbells, as the need to change weights four times (twice for each dumbbell) is time consuming, creates a clutter of small weighted disks about the gym, and can be dangerous if one of the four changes is not properly done causing a weight to fall off in use. Another problem with dumbbells for the average commercial or club gymnasium is that a rack of up to forty dumbbells, two each from five to one hundred pounds, is expensive and space consuming.

The average user is far below the level of Olympic competition mentioned above. An average user will use a pair of dumbbells weighing five, ten, fifteen and up to fifty pounds each, while some may use dumbbells up to one hundred or even two hundred pounds each. The heavier dumbbell weights may be used to exercise the biceps and shoulders with the elbows close to the user's side. However, when a user extends his or her arms, the amount of weight that can be lifted drops dramatically.

The average user of a dumbbell will find it difficult to conduct some arm exercises by changing from twenty to twenty-five pounds, for example. A solution to this problem is to provide an exercise device which can quickly and easily add two and one-half pounds or even less to each dumbbell, so that the user may exercise with a weight of twenty-two and one-half pounds, for example, in each hand. By providing a pair of exercise devices which may be simply and quickly added to a dumbbell pair, a user may quickly and safely increase his or her weights without creating a clutter in the gymnasium or requiring an even larger complement of weights. One such exercise device is shown in patent application Ser. No. 08/125,751, filed on Sep. 24, 1993, entitled Exercise Device, by the inventor of the present invention, David P. Carpenter, now U.S. Pat. No. 5,415,607, issued May 16, 1995.

SUMMARY OF THE INVENTION

The present invention incorporates all of the advantages of the exercise device of the prior art and patent application discussed above. In addition, the present invention has the advantage of providing a separate handle that may be used by the individual exercising with dumbbells to permit a second party to hand the dumbbells to the user or to remove the dumbbells from the user's grasp. This permits the user to safely exercise with heavier weights or to exercise a little longer, to the point of near exhaustion of the particular muscle set being exercised, knowing that a friend acting as a spotter may safely remove the dumbbells from the user's grasp.

Accordingly, it is an object of the present invention to provide an exercise device with a separate handle to permit the removal of a dumbbell from a user's grasp.

Another object of the present invention to provide an arrangement, such as a hook, that permits an exercise device to fit about any sized bar of any dumbbell.

Yet another object of the present invention is to provide a specially shaped hook, that will prevent that hook from interfering with the wrist of a user of a dumbbell and which extends beyond the disks of the dumbbell to prevent the dumbbell from rolling.

A further object is to provide a pair of hooks that may be expanded by a handle to permit an improved exercise device of the present invention to be added to any shaped dumbbell and to be secured thereto to prevent easy removal.

Another further object is to provide an improved exercise device that may easily vary the weight of a pair of dumbbells in smaller increments than is normally available for users of such dumbbells.

Yet another further object of the present invention is to provide an improved exercise device that may be easily disassembled and stored for transportation.

Still another object of the present invention is to provide an improved exercise device that may be used to exercise the wrists and forearms by resting upon either the inner or outer portion of the wrist.

Still another further object of the present invention is to provide an improved exercise device that, in addition to preventing the dumbbell upon which it is mounted from rolling, also sits easily upon a surface when not in use.

In accomplishing these and other objects, an improved exercise device is formed with a handle and a pair of weighted hooks attached to the handle. Each weighted hook has an opening therein for engaging the bar of a dumbbell to permit the dumbbell to hang from the hook and thus permit an individual to remove the dumbbell from its user's grasp.

DRAWINGS

Other objects and advantages and a better understanding of the improved exercise device of the present invention will become apparent after reference to the specification and the accompanying drawings, wherein.

Figure 6:
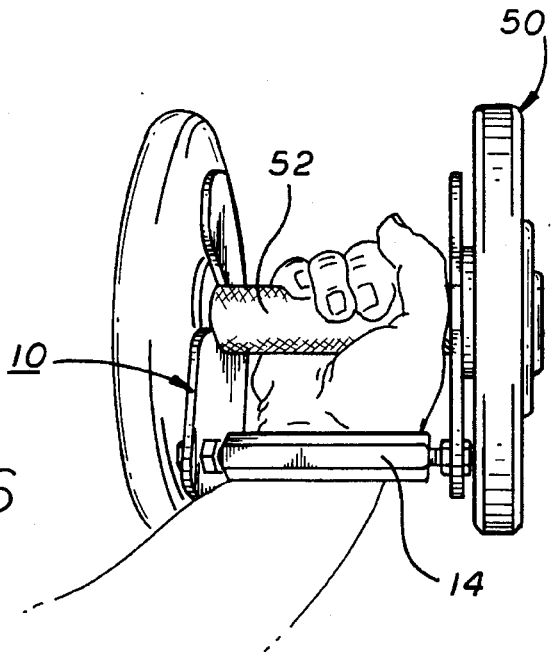
Figure 7:
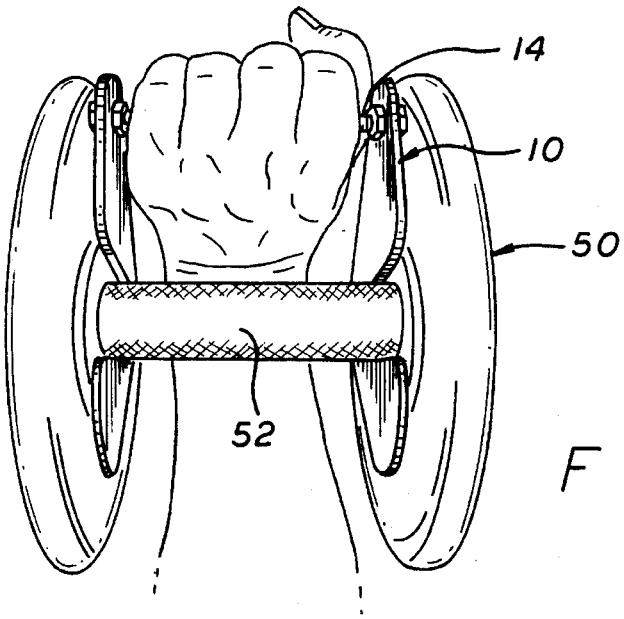

FIG. 6 shows the improved exercise device as it might be used in the right hand grasp of the user, with the user grasping the bar of the dumbbell while the handle of the exercise device rests against the user's inner wrist; and FIG. 7 shows the improved exercise device as it might be grasped in the user's left hand, with the user grasping the handle of the exercise device while the bar of the dumbbell rests against the outer portion of the user's wrist.

DESCRIPTION OF THE PREFERRED EMBODIMENT

Figure 1:
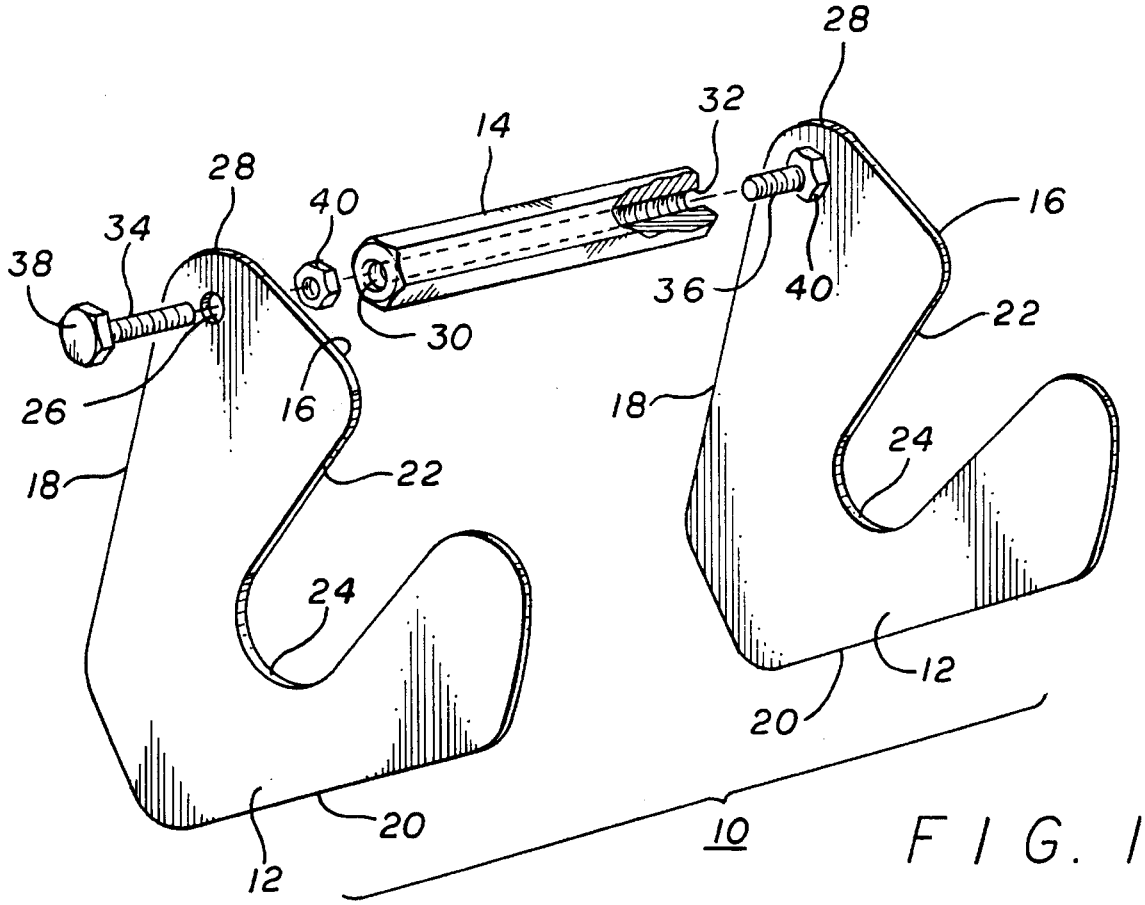
FIG. 1 is a perspective, exploded view, showing a pair of hooks with a handle and a pair of threaded studs for attaching each hook to the handle.
Figure 2:
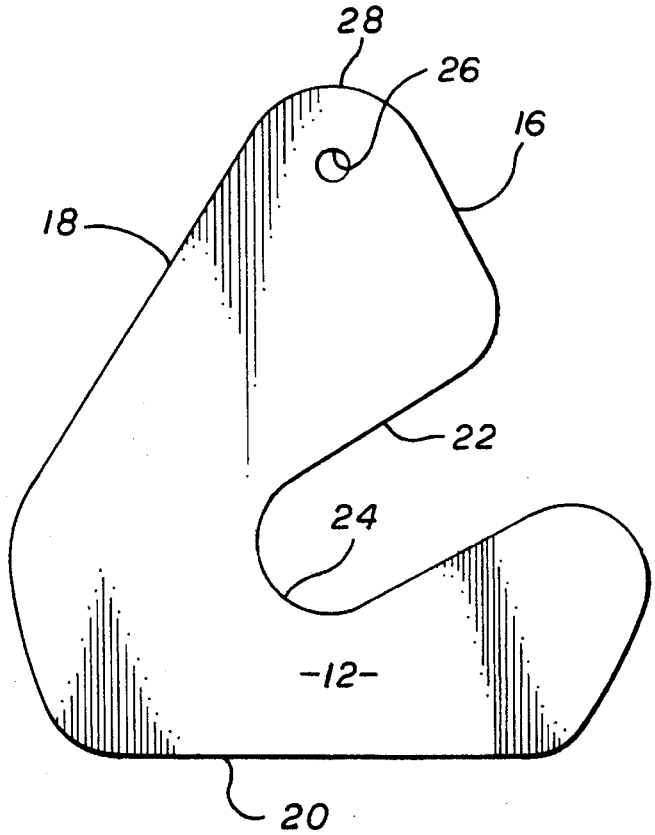
FIG. 2 is a plane view of the weighted hook of the present invention.

Referring now to the drawings, FIG. 1 shows an exploded perspective view of the improved exercise device 10 having a pair of weighted hook members 12 joined by a handle 14. As best seen in FIG. 2, the weighted hook member 12 is formed by a flat plate of 3/16" corrosion-resistant steel whose weight is designed so that two hook members 12 in combination with handle 14 and other elements of the exercise device 10 will add up to a predetermined, desired incremental weight, such as two and one-half pounds. Each hook 12 is generally triangular shaped in the form of an equilateral or isosceles triangle having a right side 16, as viewed in FIG. 2, a left side 18 and a base 20. In the preferred embodiment, the right side 16 is provided with a hook opening 22 that is designed to be large enough to fit about most, if not all bars of a dumbbell. The parallel sides of hook opening 22 terminate in a semicircular hook bottom 24 which is generally aligned with a perpendicular centerline of base 20 that extends from base 20 to the intersection of sides 16 and 18. Also located along this perpendicular centerline of base 20 is an aperture 26 used to connect handle 14 to hook member 12, as will be described below. The configuration of the weighted hook member 12 permits the hook bottom 24 to receive and hang the bar of a dumbbell to permit an individual to remove the dumbbell from its user's grasp. It will be seen in FIG. 2 that all corners of the weighted hook member 12 have been rounded. Because of the location of the bottom of hook slot 24, the corner formed by the intersection of sides 16 and 18 is furthest from the center of the exercise device 10 formed at the center of hook bottom 24. The purpose of this intersection 28 will be described below with regard to FIG. 3.

Referring once again to FIG. 1, it will be seen that the handle 14, which may be formed from a hexagonal rod of corrosion-resistant steel is provided with a pair of threaded apertures 30 and 32. These threaded apertures may be formed by drilling or otherwise forming an aperture along the longitudinal axis of handle 14 from end to end and then threading that aperture from each side. In the preferred embodiment, threaded aperture 30 may be a right-hand thread; while threaded aperture 32 may be a left-hand thread. Mounted within the apertures 26 in the pair of weighted hook members 12 are a pair of threaded studs 34 and 36. As seen in FIG. 1, each stud 34, 36 may be formed from a hexagonal bolt 38 that passes through the aperture 26 in member 12 and is attached thereto by a hexagonal nut 40. In the preferred embodiment, the threaded stud 34 is threaded with a right-hand thread, while threaded stud 36 is threaded with a left-hand thread.

Other methods of attaching the threaded studs 34, 36 to hook members 12 are available, such as welding, which eliminates the need for nuts 40. Further, handle 14 may be manufactured with reduced shoulder portions extending from either end along its longitudinal axis. The two shoulders may be threaded as threaded studs and then inserted into threaded apertures 26. Here, it would be desirable to thread the threaded studs of handle 14 with right- and left-hand threads and to thread the apertures 26 with right-hand and left-hand threads. Another alternative for attaching handle 14 to hook members 12 is to pass a hexagonal bolt 38 through a clearance hole 26 in one of the hook members 12 so that the handle 14 rotated freely on one member 12. A threaded stud extending from handle 14 into a threaded aperture 26 in the opposite member 12 would then permit rotation of handle 14 to turn freely in one member, while moving the other member in or out along the threads.

In the preferred embodiment, however, a pair of right- and left-hand threaded studs 34 and 36 may extend from hook members 12 into appropriately threaded apertures 30 and 32 in handle 14 or vice versa. In this arrangement, rotation of handle 14 causes hook members 12 to move outwardly along the axis of handle 14 to engage the outer surfaces of hook members 12 firmly against the inner surfaces of the disks that form a dumbbell upon which the improved exercise device 10 is intended to be used.

Figure 3:
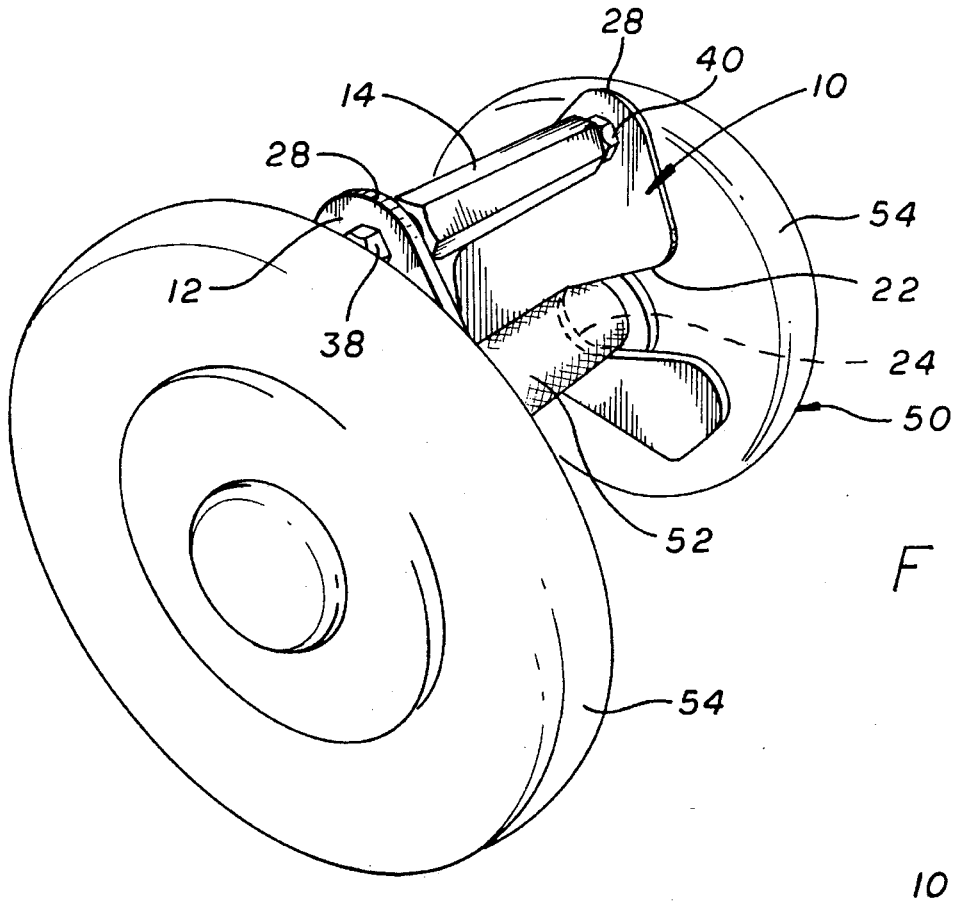
FIG. 3 is a perspective view showing the improved exercise device as it might attach to a dumbbell.

FIG. 3 shows the improved exercise device 10 of the present invention mounted upon a dumbbell 50, having a bar 52 with weighted disks 54 on each end thereof. It will be seen that the hook opening 22 fits easily about the dumbbell handle 52 and permits that handle to hang from the hook bottom 24. As discussed above, rotation of handle 14 causes the right- and left-hand threaded apertures 30 and 32 (shown in FIG. 1) to cause the threaded studs 34, 36 (also shown in FIG. 1) to urge hook members 12 out against the inner surfaces of weighted disks 54 for securely attaching the exercise device 10 to dumbbell 50. It may now be seen that the extended intersection 28 of sides 16 and 18 of each hook member 12 (FIG. 2) normally extends beyond the weighted disks 54 of dumbbell 50 to prevent that dumbbell from rolling when not in use.

Figure 4:
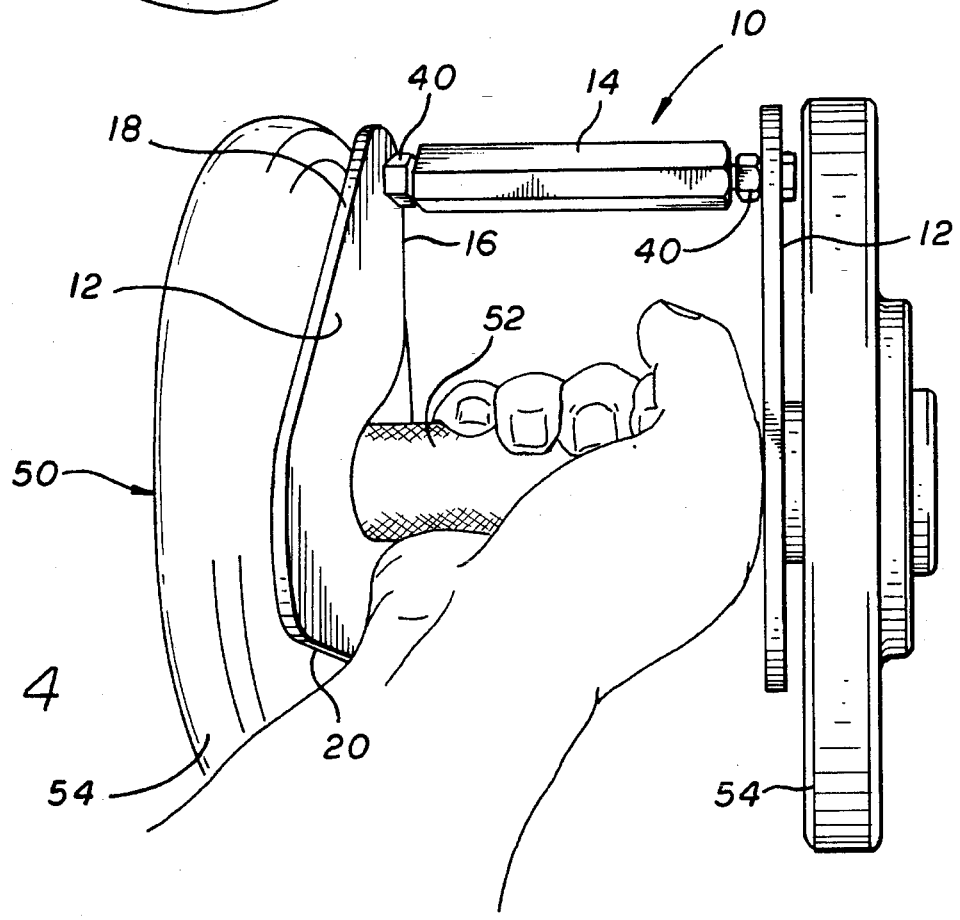
FIG. 4 is a perspective view showing the improved exercise device attached to a dumbbell as a user might hold it to exercise his or her right arm.

Referring now to FIG. 4, the exercise device 10 is shown securely attached to a dumbbell 50 and a user grasping the dumbbell bar 52 in his or her right hand. It may now be noted how the flats or sides 16, 18, 20 of each triangular shaped hook member 12 have been designed to avoid the user's wrist when the user is handling a relatively heavy dumbbell.

Figure 5:
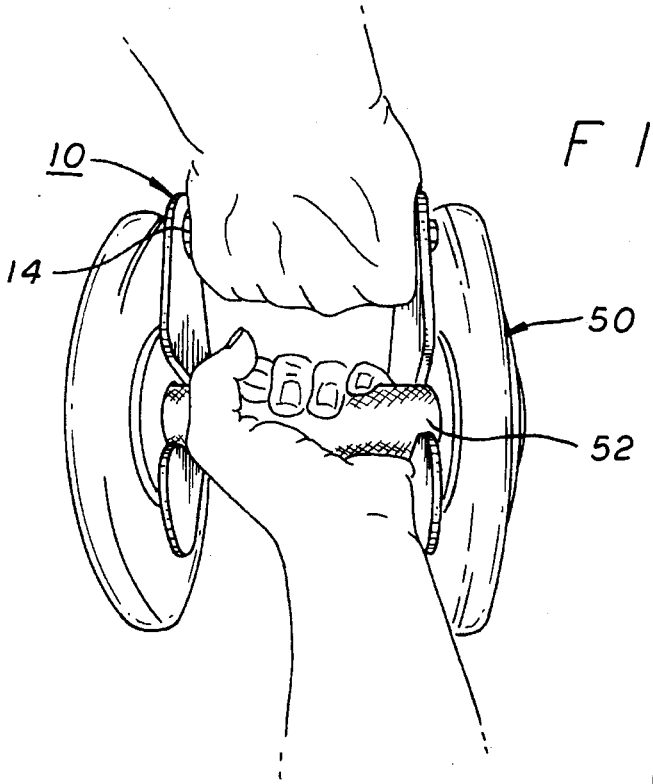
FIG. 5 is a perspective view showing the user lifting the dumbbell in his or her left hand, while an individual assists the user by either handing the user a dumbbell by holding the handle of the improved exercise device or by removing the dumbbell from the user's grasp.

FIG. 5 shows a user grasping the dumbbell 50 about its handle 52 in his or her left hand while showing how the improved exercise device 10 works best. In FIG. 5, a spotter for the user may grasp the handle 14 of the exercise device 10 to place a relatively heavy dumbbell into the user's grasp or to remove the same from the user. The improved exercise device 10 may also be designed to weigh two and one-half pounds or some other suitable increment, for example, to permit the user to go from a twenty pound dumbbell to a twenty-two and one-half pound dumbbell in an incremental step by adding the improved exercise device 10.

FIGS. 6 and 7 show the improved exercise device 10 as it may be used to exercise different muscles of the user's forearm and upper arm. In FIG. 6, the exercise device 10 is securely attached to the dumbbell 50 and shows a user grasping the dumbbell about its bar 52 in such a way as to permit the handle 14 to rest against the inner wrist of the user. This gripping arrangement may be reversed to permit the handle 14 to rest against the outer surface of the user's wrist. FIG. 7 shows yet another arrangement wherein the user may grasp the handle 14 of the exercise device 10 while permitting the bar 52 of the dumbbell 50 to rest against the outer or inner surface of the user's wrist. It will be understood that the arrangement shown in FIG. 7 permits the user to move the center of gravity of the dumbbell 50 closer to the user's body. This arrangement is yet another way in which the improved exercise device 10 permits the user to increase the effective weight of the device 10 and dumbbell 50 by first grasping handle 14 (FIG. 7) to move the effective weight closer to the body thus reducing the lifting effort and then grasping the bar 52 to move the effective weight further from the body to increase the lifting effort. As shown in FIGS. 6 and 7, the improved exercise device 10 permits additional muscle sets of the user's body to be exercised by a dumbbell 50 which would not otherwise be permitted without use of the exercise device.

It will be understood that the exercise device 10 of the present invention may be made with different shapes of the hook members 12 and handle 14 and with different methods of attaching handle 14 to the hook members 12. Further, materials other than those described above may be utilized, as may different weights. Within the foregoing teachings, it is clear that other modifications are possible and that the present invention should be limited only by the appended claims.

I claim:

1. An exercise device for use with a dumbbell, said dumbbell having a bar with weighted disks at each end thereof, comprising:

a handle;

a pair of weighted hooks, each having a hook opening for engaging said bar;

a pair of threaded members, each extending between said handle and said pair of weighted hooks;

said threaded members arranged to move said pair of weighted hooks into engagement with said disks upon rotation of said handle.

2. An exercise device, as claimed in claim 1, additionally comprising:

said pair of weighted hooks including a pair of weighted plates having a generally triangular, three-sided periphery, with said hook opening extending from one of the three sides of said periphery toward the center of each plate.

3. An exercise device, as claimed in claim 2, additionally comprising: said triangular, three-sided periphery of each plate includes flats formed by each side that provide a stable base upon which to set the exercise device when not in use.

4. An exercise device, as claimed in claim 2, additionally comprising:

said hook opening in said pair of weighted hook plates extending from one side of said three-sided periphery toward the center of a side adjacent to said one side to form a hook bottom located closest to said adjacent side, such that said hook bottom is furthest away from the intersection of said one side and the remaining third side.

5. An exercise device, as claimed in claim 4, wherein:

said pair of threaded members are attached to said pair of weighted plates near said intersection of said one side and the remaining third side.

6. An exercise device, as claimed in claim 1, additionally comprising:

said pair of threaded members including a pair of threaded studs attached to said weighted hooks;

one threaded stud having a right-hand thread and the other a left-hand thread; and said handle having two discrete ends with a right-hand threaded aperture in one end and a left-hand threaded aperture in the other.

7. An exercise device, as claimed in claim 1, additionally comprising: 'said pair of threaded members including a pair of threaded studs extending from opposite ends of said handle along a longitudinal axis thereof;

said pair of weighted hooks each having threaded apertures therein for receiving said threaded studs; and said threaded studs and threaded apertures including right-hand threads and left-hand threads.

8. An exercise device, as claimed in claim 1, wherein:

said exercise device and its component parts including said handle, said pair of weighted hooks and said pair of threaded members total a weight of two and one-half pounds.

9. An exercise device for use with a dumbbell, said dumbbell having a bar with weighted disks at each end thereof, comprising:

a handle having a longitudinal axis;

a pair of weighted members, each having a hook opening for engaging said bar;

a pair of threaded members, each extending along said axis of said handle;

said threaded members arranged to move one weighted member with respect to the other along said axis of said handle into engagement with said disks upon rotation of said handle.

10. An exercise device, as claimed in claim 9, additionally comprising:

each hook opening configured to receive said bar of said dumbbell and to hang said bar therefrom.

* * * * *